US010766129B2

(12) United States Patent
Chang

(10) Patent No.: US 10,766,129 B2
(45) Date of Patent: Sep. 8, 2020

(54) TORQUE-ADJUSTABLE PNEUMATIC TOOL

(71) Applicant: AIRBOSS AIR TOOL CO., LTD., Taichung (TW)

(72) Inventor: Hsin He Chang, Taichung (TW)

(73) Assignee: AIRBOSS AIR TOOL CO., LTD., Taichung (TW)

( * ) Notice: Subject to any disclaimer, the term of this patent is extended or adjusted under 35 U.S.C. 154(b) by 188 days.

(21) Appl. No.: 15/883,635

(22) Filed: Jan. 30, 2018

(65) Prior Publication Data

US 2019/0232480 A1 Aug. 1, 2019

(51) Int. Cl.

| | |
|---|---|
| ***B25F 5/00*** | (2006.01) |
| ***B25F 5/02*** | (2006.01) |
| ***B25B 21/00*** | (2006.01) |

(52) U.S. Cl.

CPC ..... *B25F 5/001* (2013.01); *B25B 21/00* (2013.01); *B25F 5/02* (2013.01)

(58) Field of Classification Search

CPC ..... B25F 5/001; B25F 5/00; B25B 23/14
USPC ..... 173/169, 221
See application file for complete search history.

(56) References Cited

U.S. PATENT DOCUMENTS 4,476,942 A * 10/1984 Elkin ..... B25F 5/00 173/168
5,377,769 A * 1/1995 Hasuo ..... B25B 21/02 173/169
5,775,439 A * 7/1998 Biek ..... B25B 21/02 173/1
5,918,686 A * 7/1999 Izumisawa ..... B25B 21/00 173/169
6,135,213 A * 10/2000 Schoeps ..... B25B 21/00 173/169
6,161,628 A * 12/2000 Liu ..... B25D 9/20 173/114

(Continued)

FOREIGN PATENT DOCUMENTS

| | | |
|---|---|---|
| EP | 0900632 | 3/1999 |
| TW | 553810 | 9/2003 |

(Continued)

OTHER PUBLICATIONS

English Abstracts for TWI526284, TWM485792, TWI432296, TWM473281, TWI342253, TWM396734, TWI325808, TWI258397, and TW553810 TWM370470,.

(Continued)

*Primary Examiner* — Gloria R Weeks
(74) *Attorney, Agent, or Firm* — Tracy M. Heims; Apex Juris, pllc.

(57) ABSTRACT

A pneumatic tool has a body and a torque adjusting unit. The body has a trigger chamber, a trigger assembly, an inlet channel, and an outlet channel. The torque adjusting unit is connected with a bottom of the body, is mounted on one end of the outlet channel, and has a silencer, a piston rod, a piston sleeve, and a spring. The silencer is mounted detachably on the bottom of the body and having a discharging chamber. The piston rod is connected adjustably with the silencer and extends into the discharging chamber. The piston sleeve is mounted around the piston rod and is axially moveable relative to the piston rod. The spring is mounted around the piston sleeve and has two ends abutting respectively the piston sleeve and the silencer.

3 Claims, 23 Drawing Sheets

(56) References Cited

U.S. PATENT DOCUMENTS

| | | | | |
|---|---|---|---|---|
| 6,902,011 | B2 * | 6/2005 | Hall | B25B 21/02 173/168 |
| 7,398,836 | B2 | 7/2008 | Elmvist et al. | |
| 7,404,450 | B2 | 7/2008 | Izumisawa et al. | |
| 8,820,432 | B2 * | 9/2014 | Nelson | B25B 23/1453 173/176 |
| 8,955,614 | B2 * | 2/2015 | Schoeps | B25B 21/00 173/168 |
| 9,044,851 | B2 * | 6/2015 | Tully | B25B 23/1453 |
| 9,557,798 | B2 * | 1/2017 | Sako | H02J 3/14 |
| 2012/0318544 | A1 * | 12/2012 | Sun | B25F 5/00 173/1 |
| 2015/0275669 | A1 * | 10/2015 | Su | B25B 21/00 60/493 |
| 2016/0075008 | A1 * | 3/2016 | Wu | B25B 21/00 173/221 |
| 2016/0332287 | A1 * | 11/2016 | Chen | B25F 5/001 |

FOREIGN PATENT DOCUMENTS

| | | | |
|---|---|---|---|
| TW | I258397 | | 7/2006 |
| TW | M370470 | | 12/2009 |
| TW | I325808 | | 6/2010 |
| TW | M396734 | | 1/2011 |
| TW | I342253 | | 5/2011 |
| TW | M473281 | | 3/2014 |
| TW | I432296 | | 4/2014 |
| TW | M485792 | | 9/2014 |
| TW | I526284 | | 3/2016 |
| WO | 2014/072174 | A1 | 5/2014 |
| WO | 2016/055566 | A1 | 4/2016 |

OTHER PUBLICATIONS

EESR of corresponding EP Application No. 18158801.3, dated Aug. 29, 2018, Total of 13 pages.

* cited by examiner

TORQUE-ADJUSTABLE PNEUMATIC TOOL

BACKGROUND OF THE INVENTION

1. Field of the Invention

The present invention relates to a pneumatic tool, and more particularly to a torque-adjustable pneumatic tool.

2. Description of Related Art

With reference to FIG. 22, a conventional pneumatic tool 70 substantially comprises a body 71, a driving device 72, a trigger assembly 73, and a silencer 74. The body 71 has a holding chamber 711, a trigger chamber 712, an inlet channel 713, and an outlet channel 714. The trigger chamber 712 is adjacent to the holding chamber 711 and extends laterally. The inlet channel 713 and the outlet channel 714 communicate with the trigger chamber 712. The driving device 72 is mounted in the holding chamber 711, and the trigger assembly 73 is mounted in the trigger chamber 712. The silencer 74 is mounted on a bottom of the body 71 and communicates with the outlet channel 714.

When the conventional pneumatic tool 70 is in use, the body 71 is connected with an air compressor with a pipe and compressed air can be led into the inlet channel 713. When the trigger assembly 73 is pressed, the compressed air will be led into the holding chamber 711 to actuate the driving device 72 and the pneumatic tool 70 works. In addition, redundant air will be discharged from the outlet channel 714.

With reference to FIGS. 22 and 23, compressed air is the power source for driving the conventional pneumatic tool 70 to operate, but the pressure of the compressed air is unstable. Thus, the torque output by the conventional pneumatic tool 70 is also unstable and will be higher or lower than a desired torque.

In addition, the conventional pneumatic tool is usually operated to lock a fastener in two stages. In the first stage, the conventional pneumatic tool is applied to initially lock the fastener with a lower torque. In the second stage, the conventional pneumatic tool is applied to lock the fastener tightly with a high torque.

However, the torque output by the conventional pneumatic tool in each stage is not adjustable, so the conventional pneumatic tool is not versatile in use.

To overcome the shortcomings, the present invention tends to provide a pneumatic tool to mitigate or obviate the aforementioned problems.

SUMMARY OF THE INVENTION

The main objective of the invention is to provide a pneumatic tool that is adjustable in torque.

The pneumatic tool has a body and a torque adjusting unit. The body has a trigger chamber, a trigger assembly, an inlet channel, and an outlet channel. The trigger chamber is defined in the body. The trigger assembly is mounted in the trigger chamber. The inlet channel and the outlet channel communicate with the trigger chamber. The torque adjusting unit is connected with a bottom of the body, is mounted on one end of the outlet channel, and has a silencer, a piston rod, a piston sleeve, and a spring. The silencer is mounted detachably on the bottom of the body and has a discharging chamber. The piston rod is connected adjustably with the silencer and extends into the discharging chamber. The piston sleeve is mounted around the piston rod and is axially moveable relative to the piston rod. The spring is mounted around the piston sleeve and has two ends abutting respectively the piston sleeve and the silencer.

Other objects, advantages and novel features of the invention will become more apparent from the following detailed description when taken in conjunction with the accompanying drawings.

DETAILED DESCRIPTION OF PREFERRED EMBODIMENT

With reference to FIGS. 1 to 4, a pneumatic tool in accordance with the present invention comprises a body 10, a signal pressure transmitting unit 20, and a torque adjusting unit 30.

Figure 1:
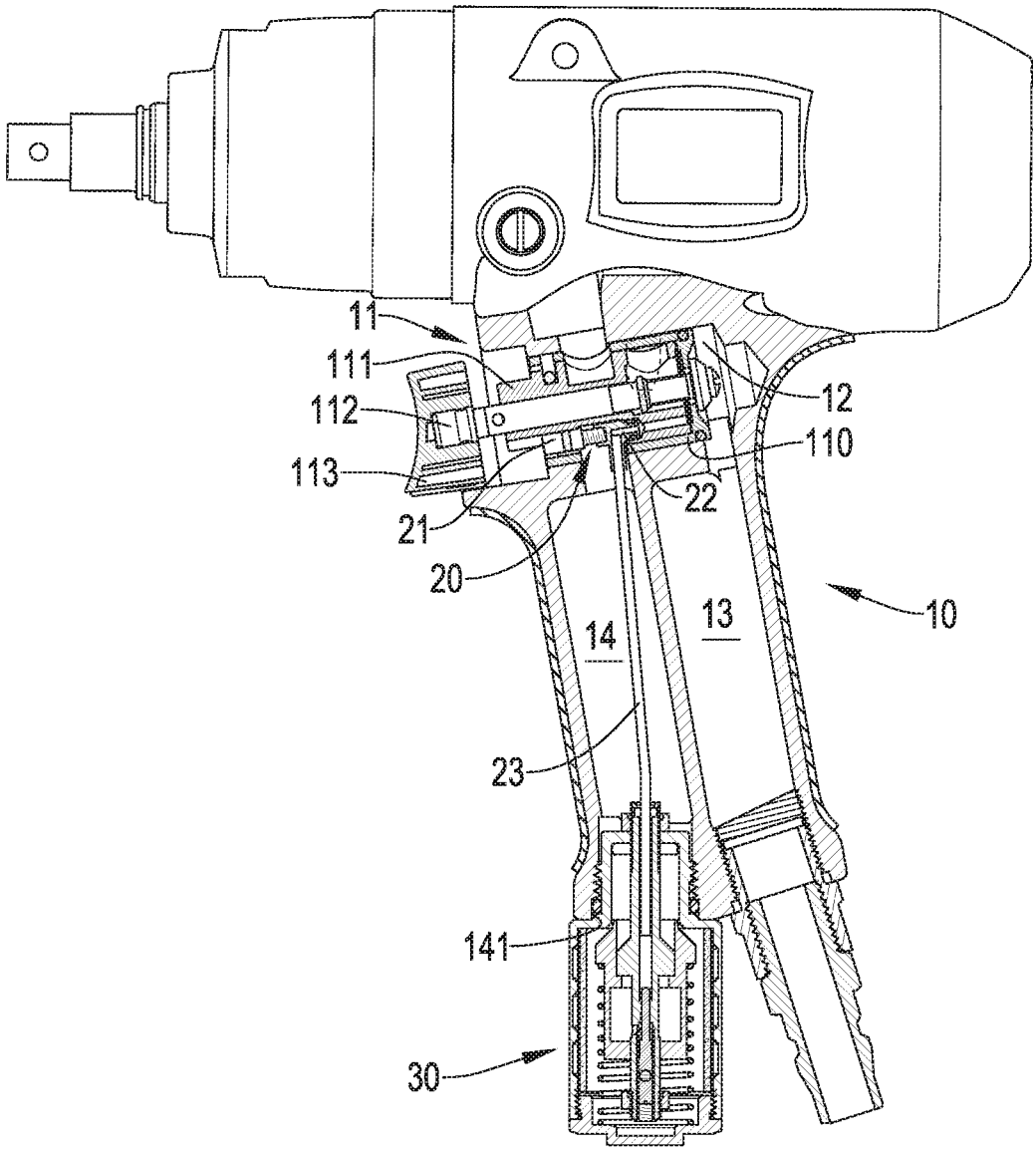
FIG. 1 is a side view in partial section of a pneumatic tool in accordance with the present invention.
Figure 2:
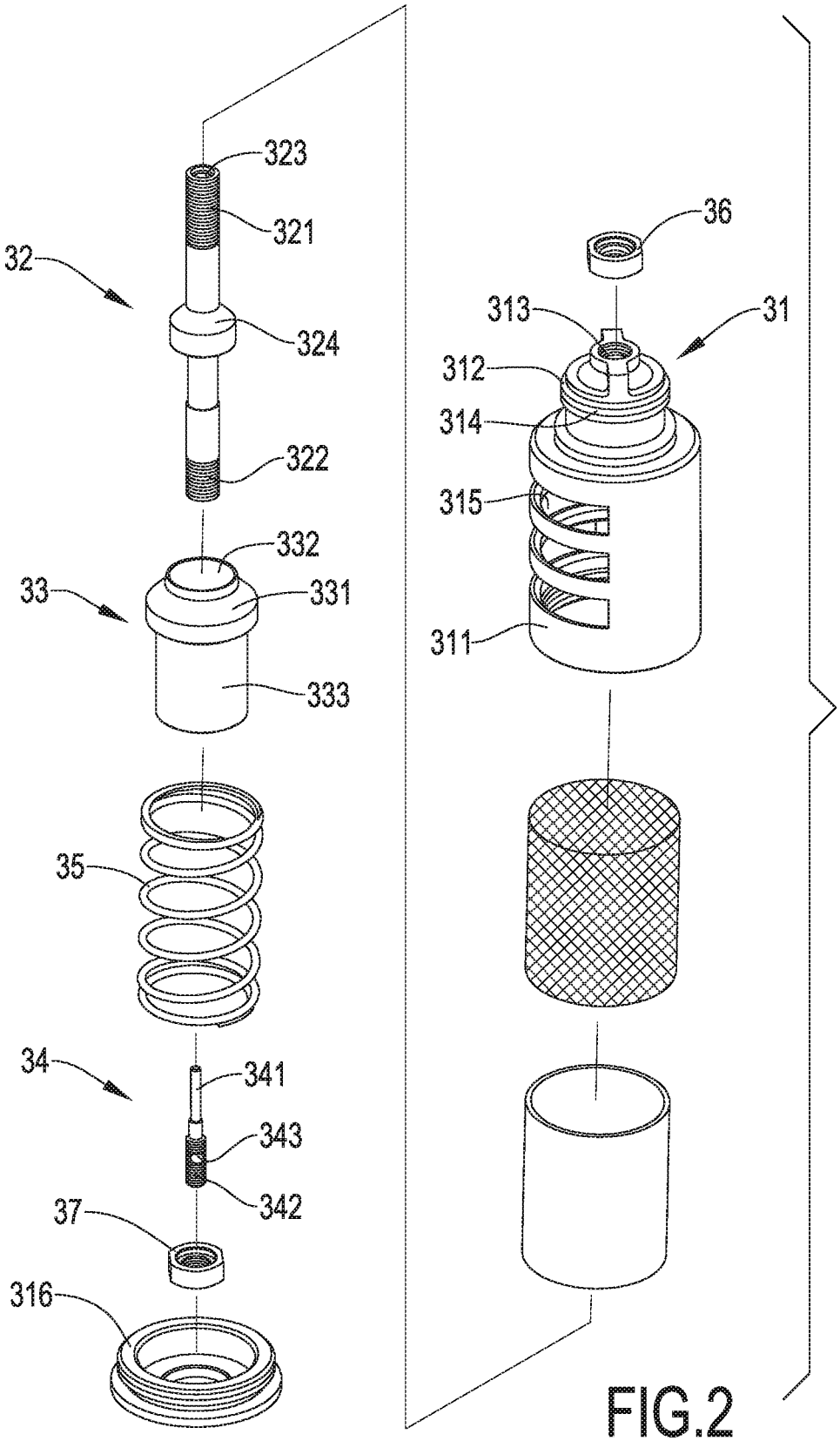
FIG. 2 is an enlarged exploded perspective view of the torque adjusting unit of the pneumatic tool in FIG. 1.

With reference to FIGS. 1 and 2, the body 10 may be conventional and has a trigger chamber 12, a trigger assembly 11, an inlet channel 13, and an outlet channel 14. The trigger chamber 12 is defined in the body 10. The trigger assembly 11 is mounted in the trigger chamber 12 and comprises a valve sleeve 110, a valve core 111, a piston pin 112, and a button 113. The valve core 111 is mounted in the valve sleeve 110. The piston pin 112 is mounted through the valve core 111. The button 113 is mounted on an end of the piston pin 112. The inlet channel 13 communicates with the trigger chamber 12, and the outlet channel 14 communicates with the trigger chamber 12. In operation, the body 10 is connected with an air compressor with a pipe. When the button 13 is pressed, compressed air can be led into the trigger chamber 12 via the inlet channel 13 and is applied to actuate a driving device mounted in the body 10 to generate torque for working.

The signal pressure transmitting unit 20 is mounted in the trigger chamber 12, is connected with the valve core 111, and comprises a positioning member 21, a signal element 22, and a guiding tube 23. The positioning member 21 may be a bolt and is mounted on a bottom of the valve core 111. The signal element 22 is mounted on the bottom of the valve core and is co-axial with the positioning member 21. The signal element 22 has a T-shaped cross section and is screwed with the positioning member 21, such that the position of the signal element 22 relative to the valve core 111 can be adjusted by rotating the positioning member 21. The guiding tube 23 has a first end connected with the signal element 22 and a second end extending into the outlet channel 14 in the body 10.

With reference to FIGS. 1 and 2, the torque adjusting unit 30 is connected with a bottom of the body 10, is mounted on an opening 141 of the outlet channel 14, and is connected with the signal pressure transmitting unit 20 by the guiding tube 23. The torque adjusting unit 30 comprises a silencer 31, a piston rod 32, a piston sleeve 33, a blocking pin 34, a spring 35, a piston rod adjusting member 36, and a piston sleeve adjusting member 37.

Figure 3:
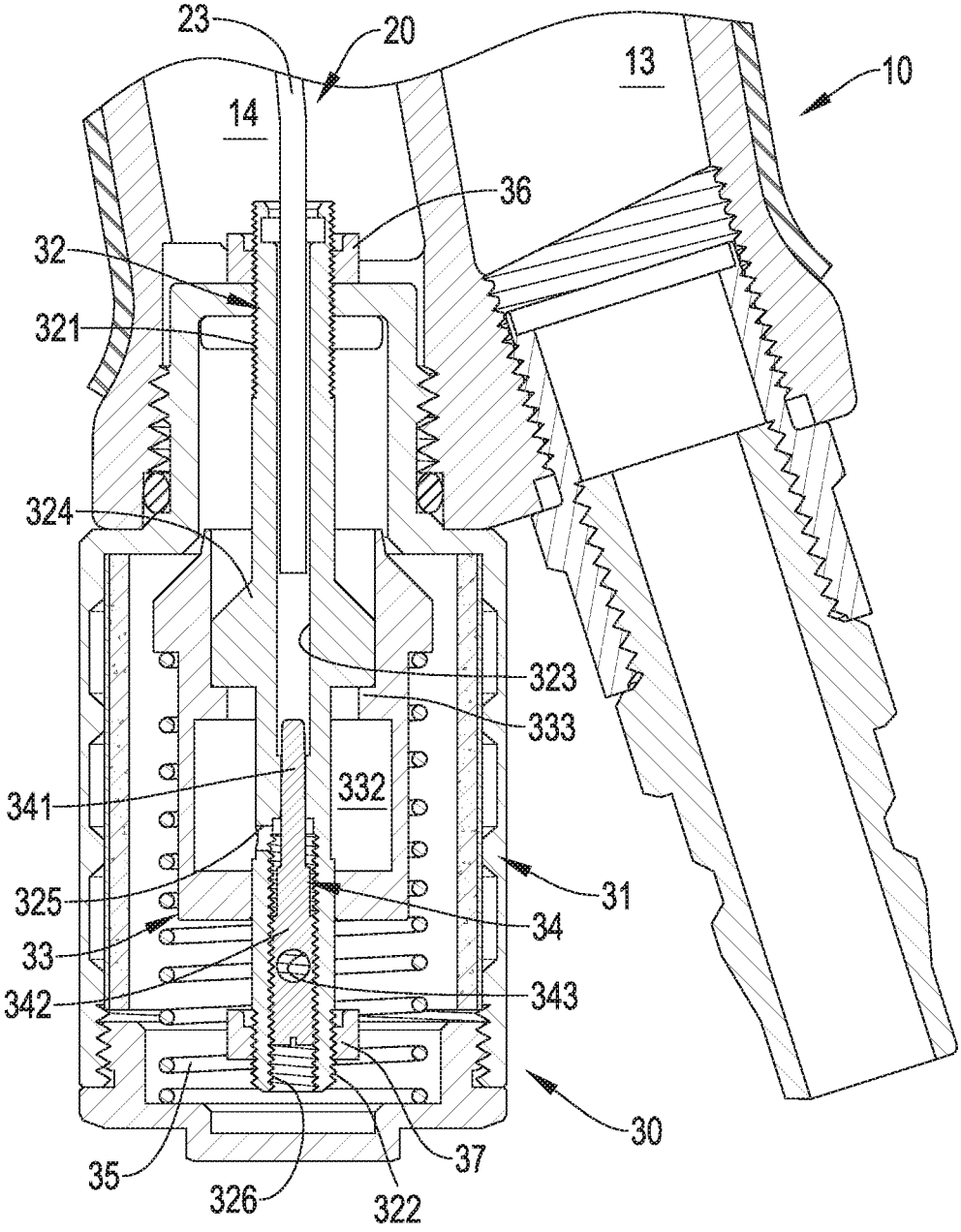
FIG. 3 is an enlarged side view in partial section of the pneumatic tool in FIG. 1.

With reference to FIGS. 2 and 3, the silencer 31 is mounted detachably on the bottom of the body 10 and has a sleeve body 311, a connection segment 312, a connection hole 313, a connection thread 314, a discharging chamber 315, and a bottom cap 316. The connection segment 312 is formed on and protrudes from a top end of the sleeve body 311. The connection hole 313 is defined in the connection segment 312 and is threaded. The connection thread 314 is formed around the connection segment 312, such that the sleeve body 311 can be connected detachably with the bottom of the body 10 by the connection thread 314. The discharging chamber 315 is defined in the sleeve body 311. The bottom cap 316 is mounted on a bottom end of the sleeve body 311.

The piston rod 32 is connected rotatably and adjustably with the silencer 31 and has a first end and a second end. The first end is provided with a first adjusting thread 321, and the second end is provided with a second adjusting thread 322. The piston rod 32 further has a guiding channel 323, an abutting flange 324, a discharging hole 325, and a pin thread 326. The guiding channel 323 is axially defined through the piston rod 32. The abutting flange 324 is formed around an outer surface at a middle of the piston rod 32. The discharging hole 325 is defined radially in the piston rod 32 at a position being adjacent to the abutting flange 324 and communicates with the guiding channel 323. The pin thread 326 is defined in a bottom end of the guiding channel 323. The first adjusting thread 321 is screwed with the connection hole 313 in the silencer 31, and the first end of the piston rod 32 extends out of a top end of the silencer 31.

The piston sleeve 33 is mounted in the discharging chamber 315 of the silencer 31, is mounted around the piston rod 32, and is axially moveable relative to the piston rod 32. The piston sleeve 33 has a guiding segment 331, a discharging space 332, and an abutting rib 333. The guiding segment 331 is formed on and around a top end of the piston sleeve 33 and has a conical top surface. The discharging space 332 is defined in the piston sleeve 33. The abutting rib 333 is annular and is formed on and protrudes from an inner surface at a middle of the discharging space 332. The abutting flange 324 of the piston rod 32 is mounted in the discharging space 332 and selectively abuts the abutting rib 333.

The blocking pin 34 is mounted in the guiding channel 323 of the piston rod 32 and comprises a blocking segment 341, a pin outer thread 342, and a through hole 343. The blocking segment 341 is formed on an upper portion of the blocking pin 34 and extends into the guiding channel 323 of the piston rod 32 to form a gap between an outer surface of the blocking segment 341 and the inner surface of the guiding channel 323. The pin outer thread 342 is formed around a lower portion of the blocking pin 34 and is screwed with the pin thread 326 in the piston rod 32. The through hole 343 is defined radially in the pin outer thread 342. The spring 35 is mounted around the piston sleeve 33 and has two ends abutting respectively the guiding segment 331 of the piston sleeve 33 and the bottom cap 316 of the silencer 31.

The piston rod adjusting member 36 is screwed with the first adjusting thread 321 on the piston rod 32 and selectively abuts the top of the connection segment 312. With the rotation of the piston rod adjusting member 36, the axial position of the piston rod 32 relative to the silencer 31 can be adjusted. The piston sleeve adjusting member 37 is screwed with the second adjusting thread 322 on the piston rod 32. With the rotation of the piston sleeve adjusting member 37, the axial position of the piston sleeve 33 relative to the piston rod 32 can be adjusted.

Figure 4:
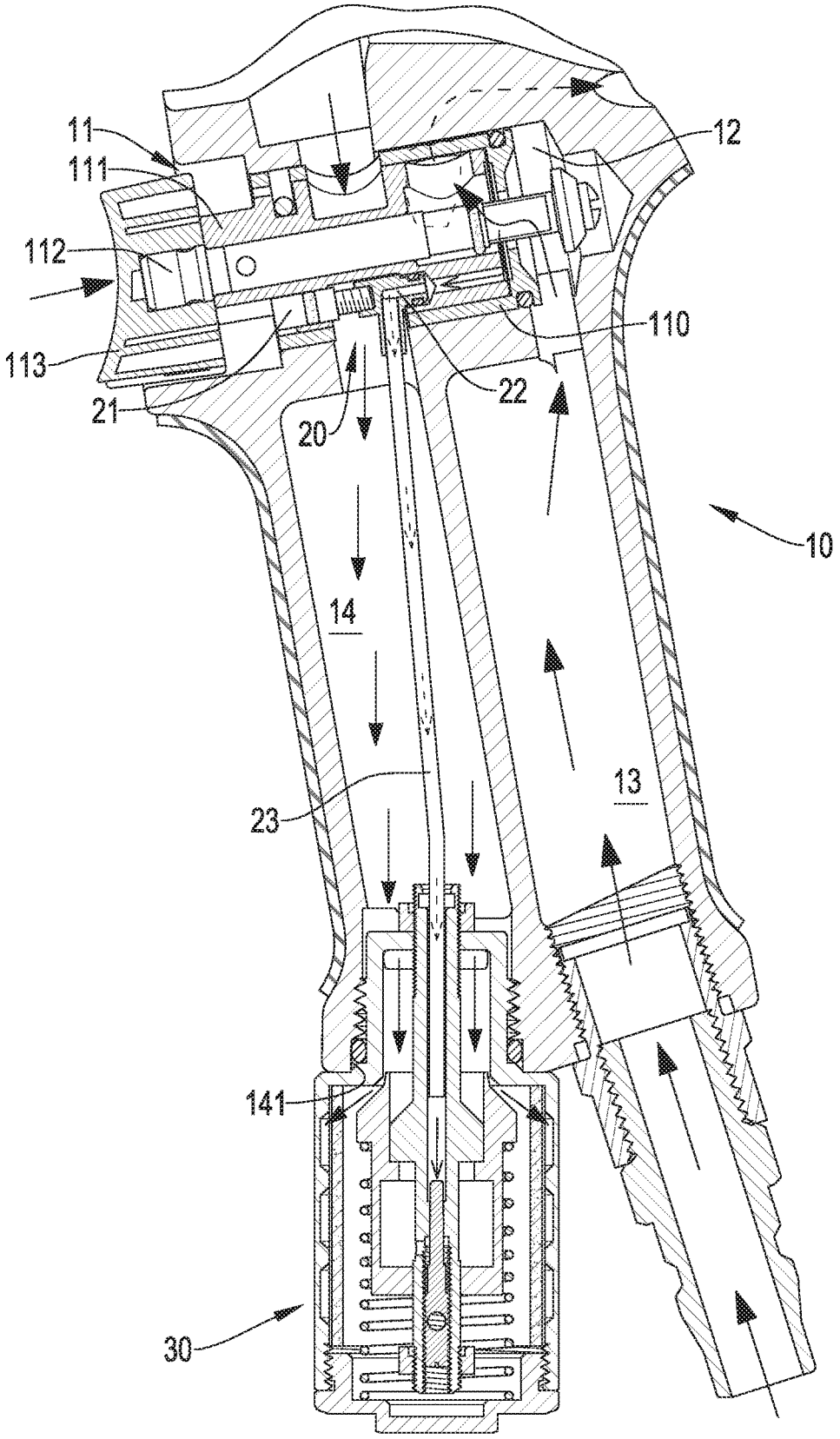
FIG. 4 is an enlarged operational side view in partial section of the pneumatic tool in FIG. 1.
Figure 5:
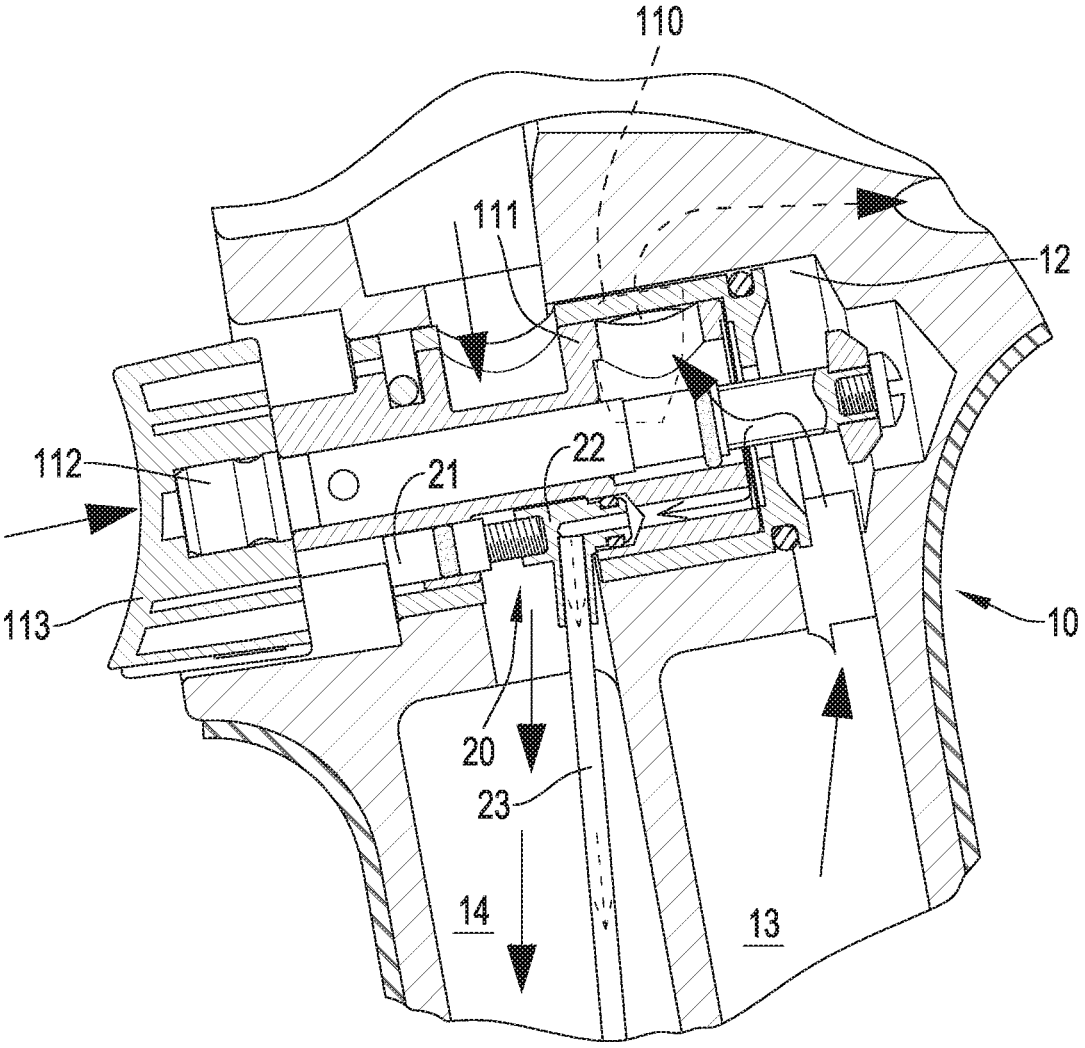
FIG. 5 is an enlarged operational side view of the pneumatic tool in FIG. 4.

With reference to FIGS. 4 and 5, in use, the pneumatic tool is connected with a compressed air source. When the button 113 is pressed, the piston pin 112 will be axially moved relative to the valve sleeve 110 and the valve core 111. At this time, the compressed air will enter the trigger chamber 12 via the inlet channel 13. Consequently, the compressed air can be applied to drive the driving device to output a torque in a first operation stage.

Figure 6:
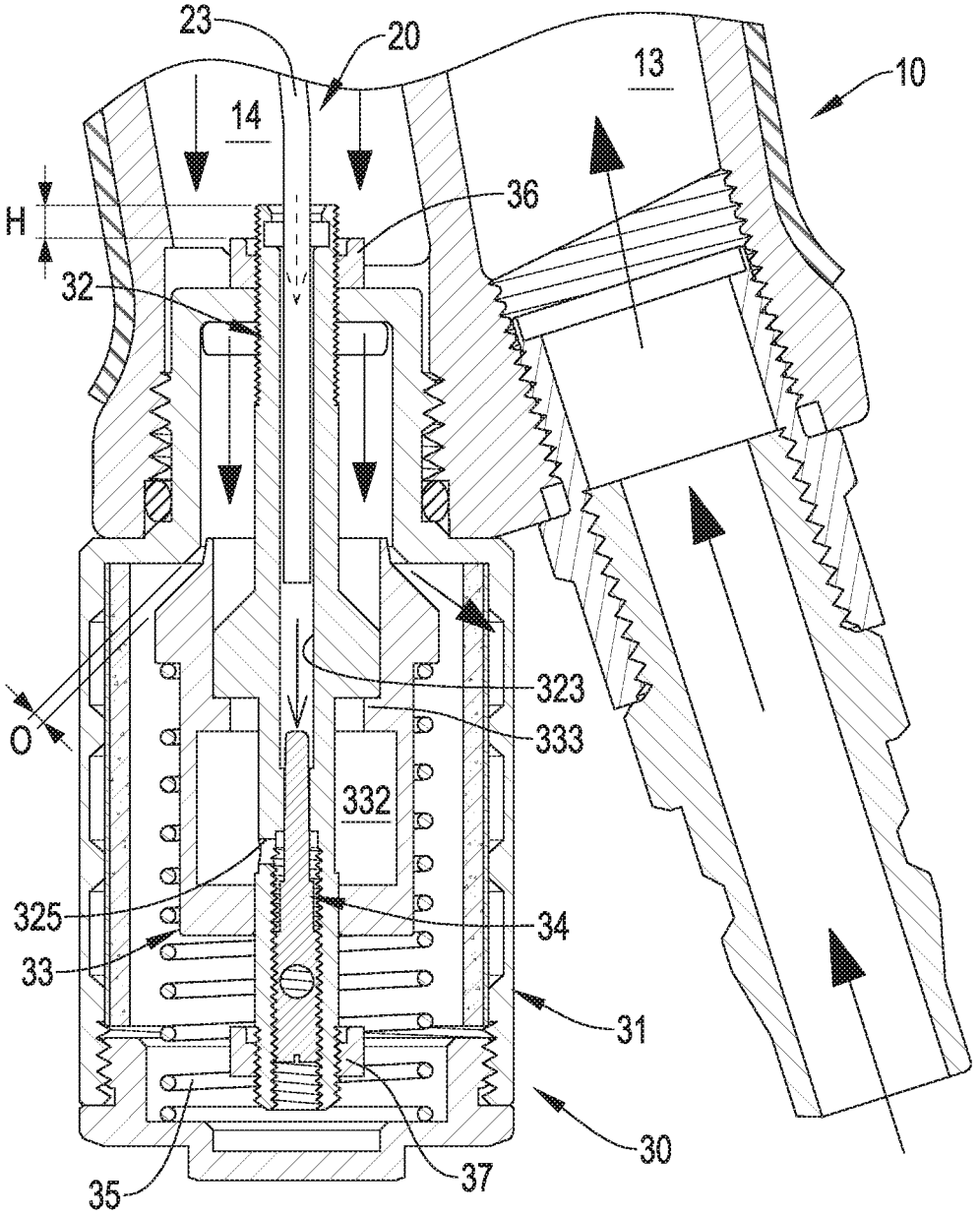
FIG. 6 is an enlarged operational cross sectional side view of the pneumatic tool in FIG. 4.
Figure 7:
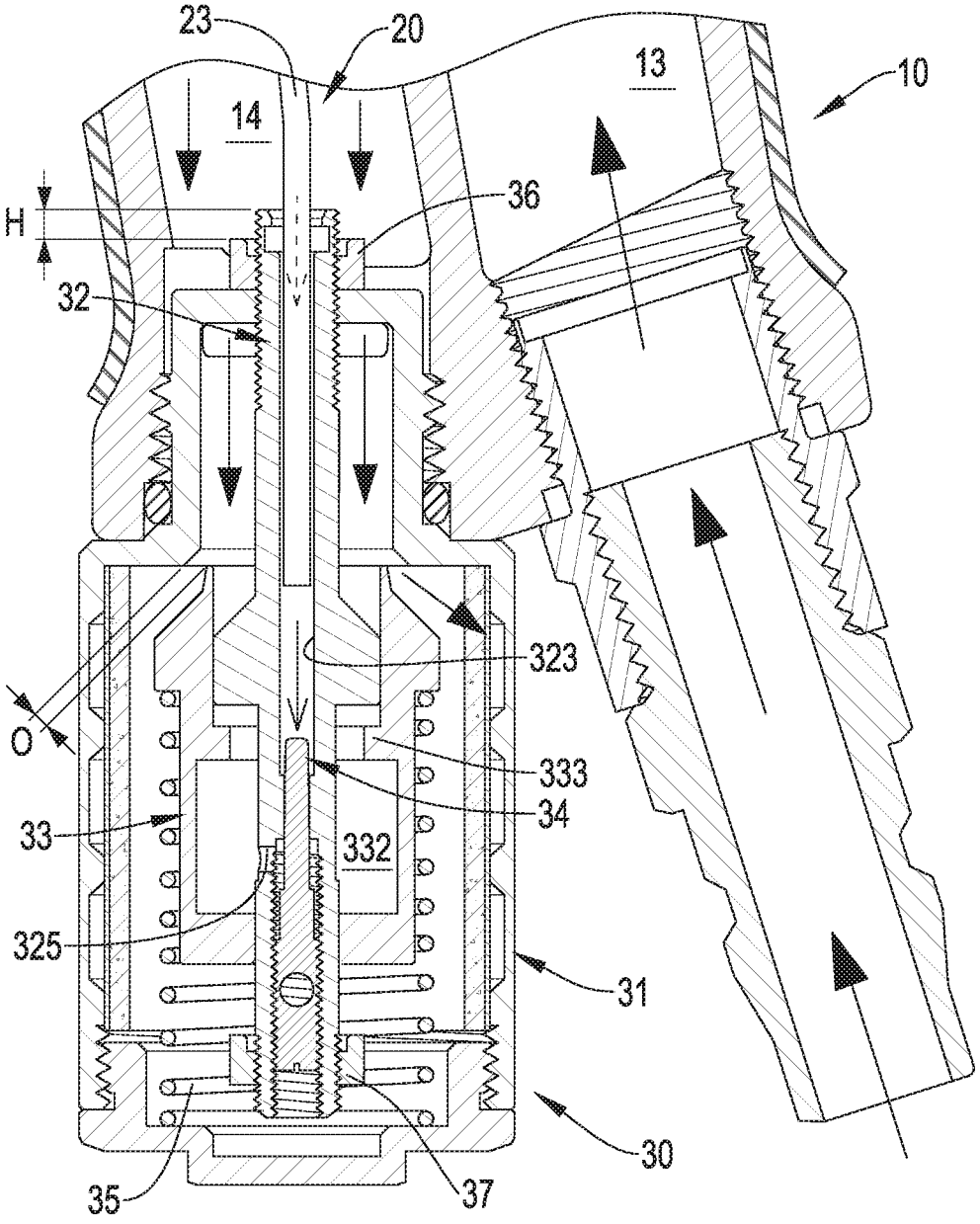
FIG. 7 is another enlarged operational cross sectional side view of the pneumatic tool in FIG. 4 showing the torque adjusting unit in the first operation stage of the pneumatic tool.

With reference to FIGS. 5 to 7, during the operation of the pneumatic tool, some of the compressed air will enter the signal pressure transmitting unit 20, wherein the pressure of the compressed air entering into the signal pressure transmitting unit 20 is defined as the signal pressure. The signal pressure will be led into the torque adjusting unit 30 via the guiding tube 23.

While the pneumatic tool is applied to output the torque in the first operation stage, the redundant compressed air that is not applied to drive the driving device will be discharged into the outlet channel 14 and enters into the torque adjusting unit 30. At this time, an original height H is defined between a top of the piston rod 32 and a top of the piston rod adjusting member 36. When the original height H is not changed and the signal pressure is equal to the pressure of the discharging air, the discharging air will push the piston sleeve 33 to move slightly and the piston sleeve 33 is moved downward relative to the piston rod 32. Consequently, a discharging gap O is formed between the silencer 31 and the piston sleeve 33 to discharge the discharging air. At this time, the amount of the discharging air is small, and the amount of the compressed air into the body 10 is also small. Thus, the pneumatic tool can be controlled at a low speed and a low torque output.

Figure 8:
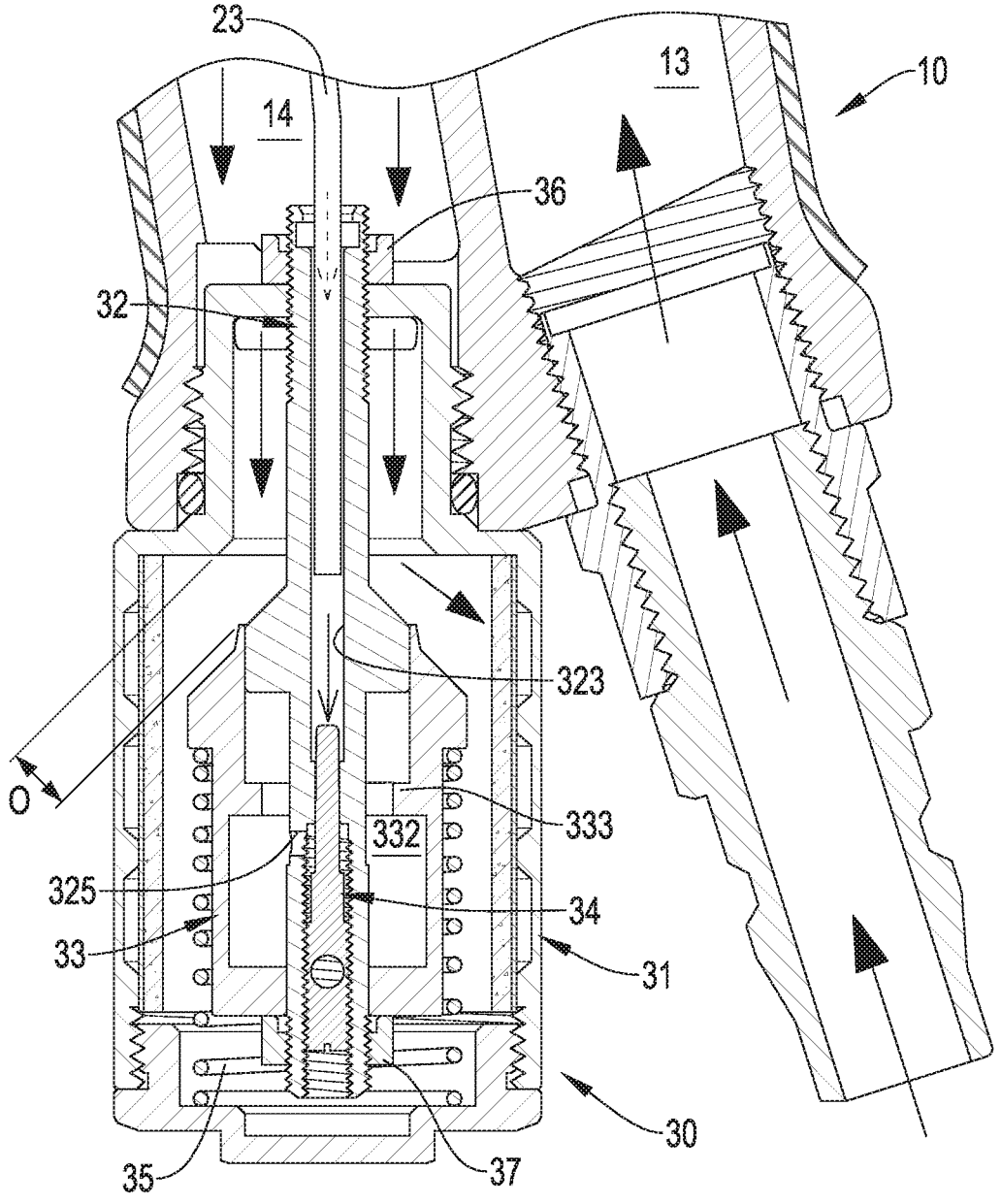
FIG. 8 is another enlarged operational cross sectional side view of the pneumatic tool in FIG. 4 showing the torque adjusting unit in the second operation stage of the pneumatic tool.
Figure 9:
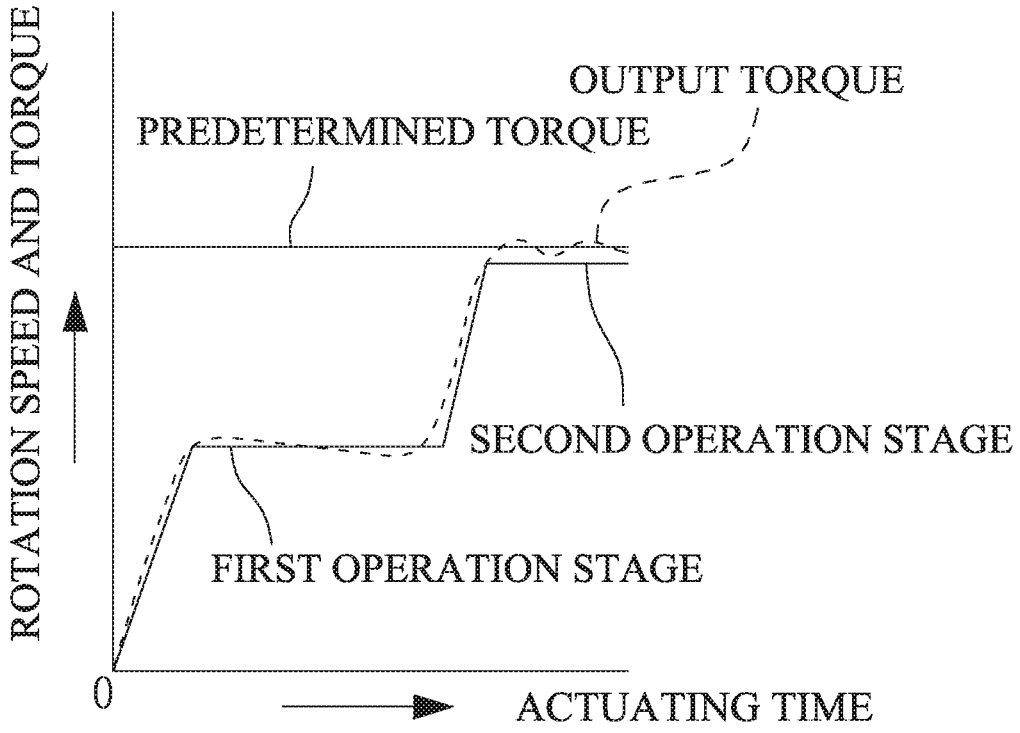
FIG. 9 is a curved diagram of torque, rotation speed, and actuating time of the pneumatic tool in FIG. 1.

With reference to FIGS. 7 and 8, to enlarge the output torque, the amount of the compressed air input into the inlet channel 13 is increased such that the pneumatic tool can output a large torque in the second operation stage. Consequently, the amount of the compressed air entering into the signal pressure transmitting unit 20 is also increased. The signal pressure enters into the torque adjusting unit 30 via the guiding tube 23 and passes through the gap around the blocking pin 34, and the signal pressure will enter into the discharging space 332 in the piston sleeve 33 via the discharging hole 325 in the piston rod 32. When the signal pressure and the pressure of the discharging air are increasing, the force applied to push the piston sleeve 33 downward will be larger than the resistant force of the spring 35. Thus, the piston sleeve 33 will be pushed to move downward relative to the piston rod 32, so the discharging gap O will be enlarged and the amount of the discharging air is increased. Accordingly, the amount of the compressed air entering into the body 10 is also increased, and the rotation speed and the torque of the pneumatic tool will be increased as shown in FIG. 9. Therefore, the pneumatic tool in accordance with the present invention can provide different rotation speeds and torques at different operation stages to fit with different use demands.

With reference to FIGS. 10 to 13, the rotation speeds and the torques at the operation stages can be adjusted by rotating the piston rod adjusting member 36. When the piston rod adjusting member 36 is rotated and the piston rod 32 is moved upward and axially relative to the silencer 31, the original height H will be increased to a first height H1 as shown on the left of FIG. 10. Accordingly, the discharging gap O will be reduced in both the first operation stage and the second operation stage. Thus, the rotation speed will be reduced, and the output torque is also decreased.

Figure 10:
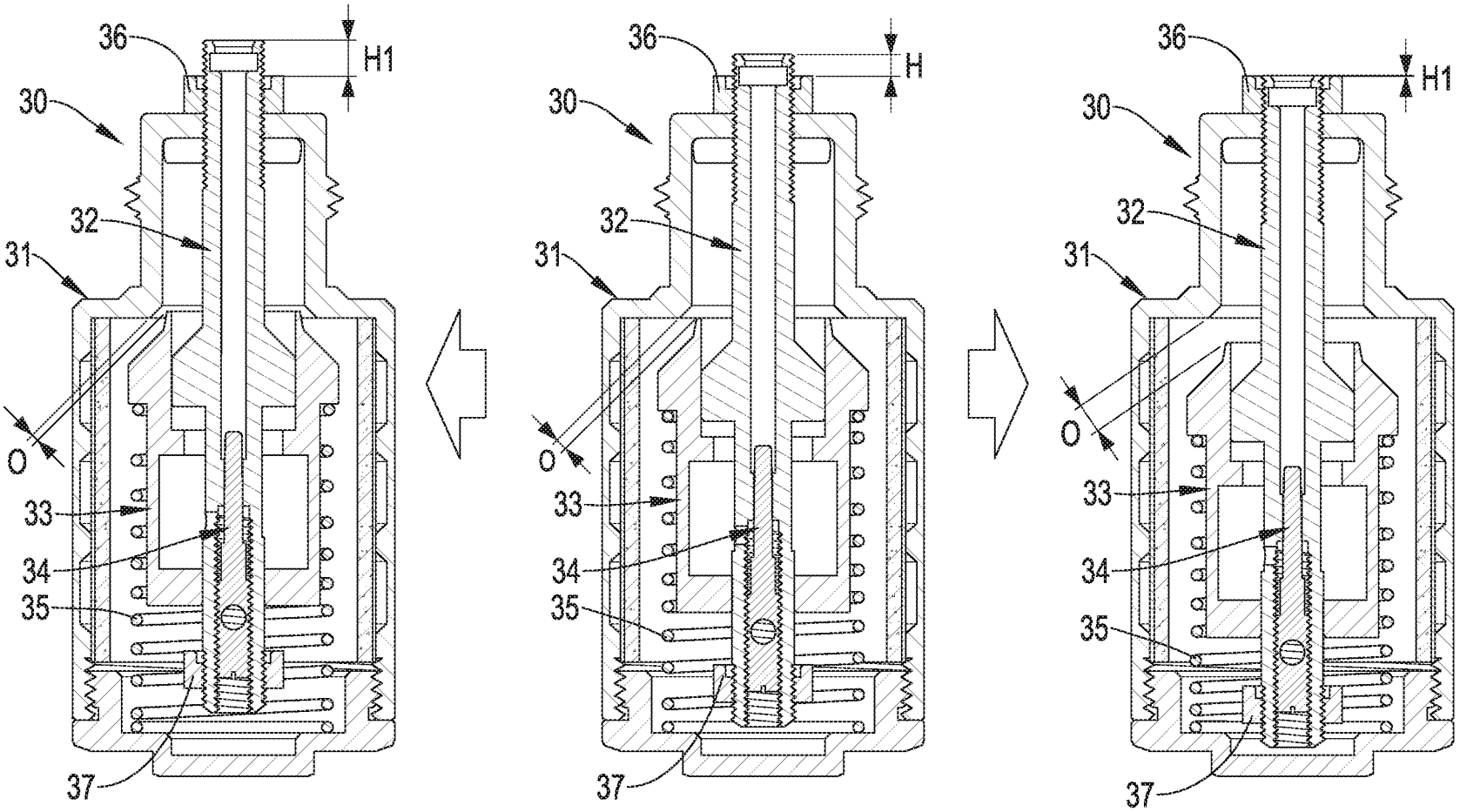
FIG. 10 shows enlarged operational cross sectional side views of the pneumatic tool in FIG. 4 showing that the piston rod adjusting member is adjusted in the first operational stage of the pneumatic tool.
Figure 11:
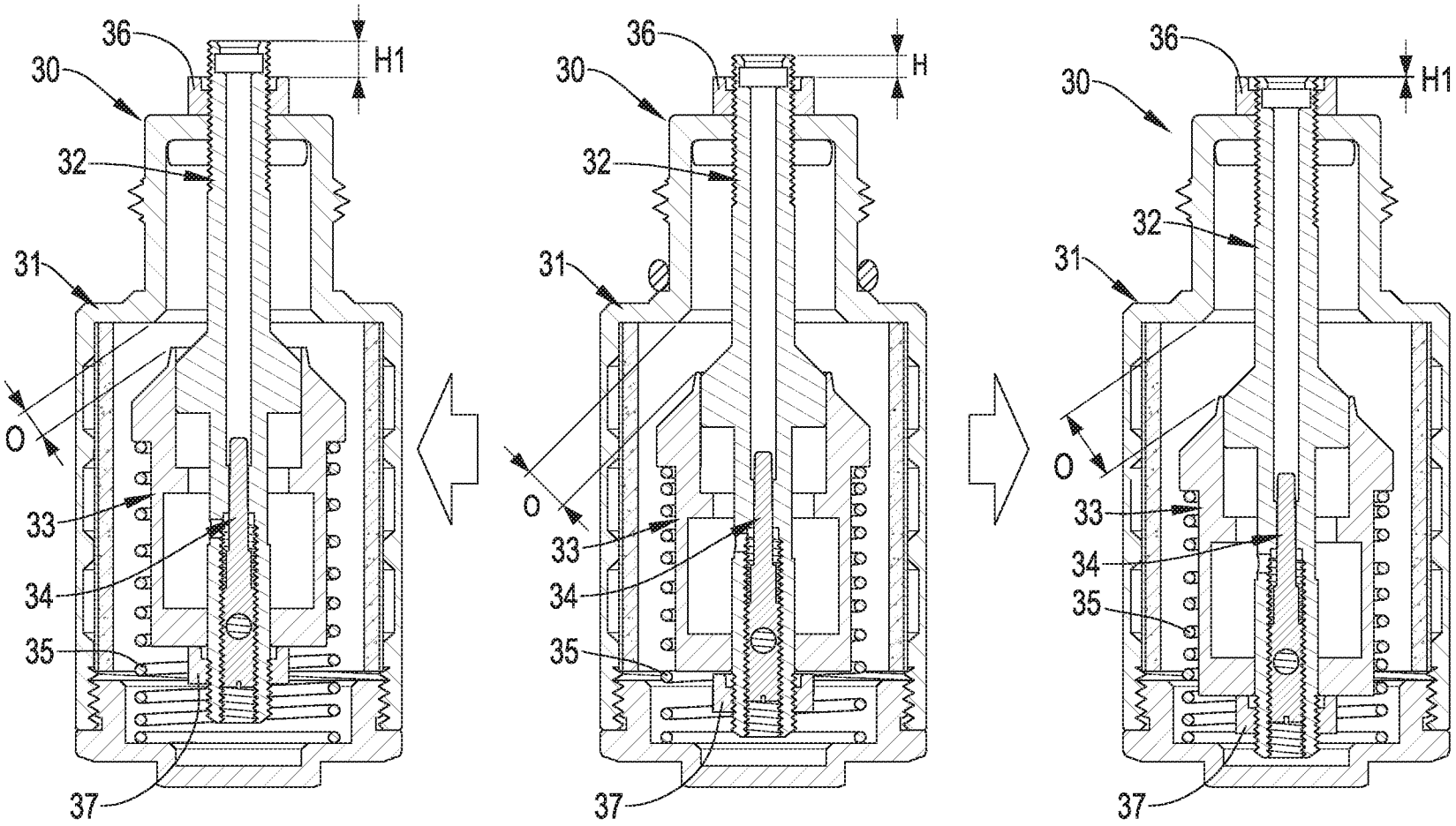
FIG. 11 shows enlarged operational cross sectional side views of the pneumatic tool in FIG. 4 showing that the piston rod adjusting member is adjusted in the second operational stage of the pneumatic tool.
Figure 12:
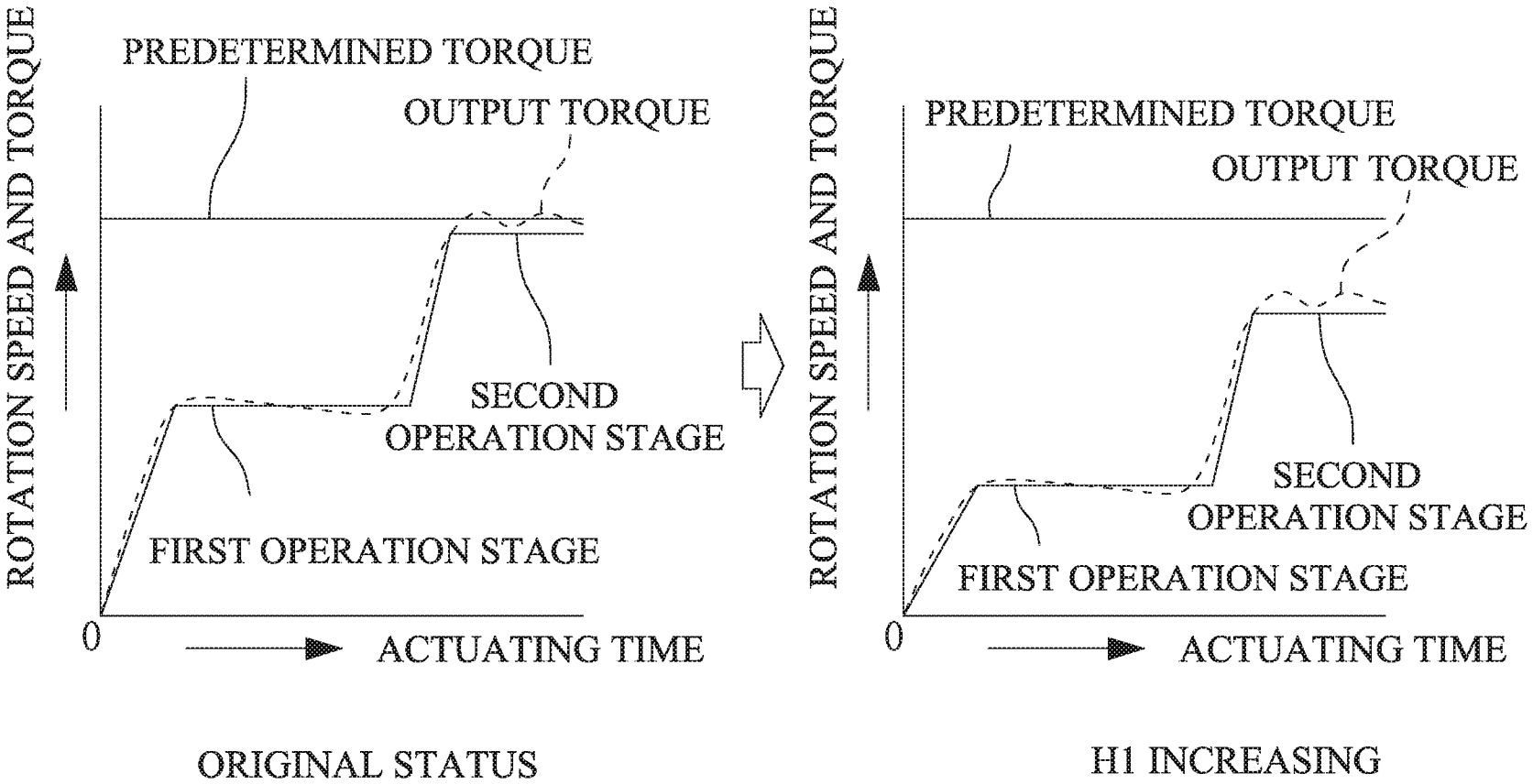
FIG. 12 shows curved diagrams of torque, rotation speed, and actuating time of the pneumatic tool in FIG. 1 after the piston rod adjusting member is adjusted.
Figure 13:
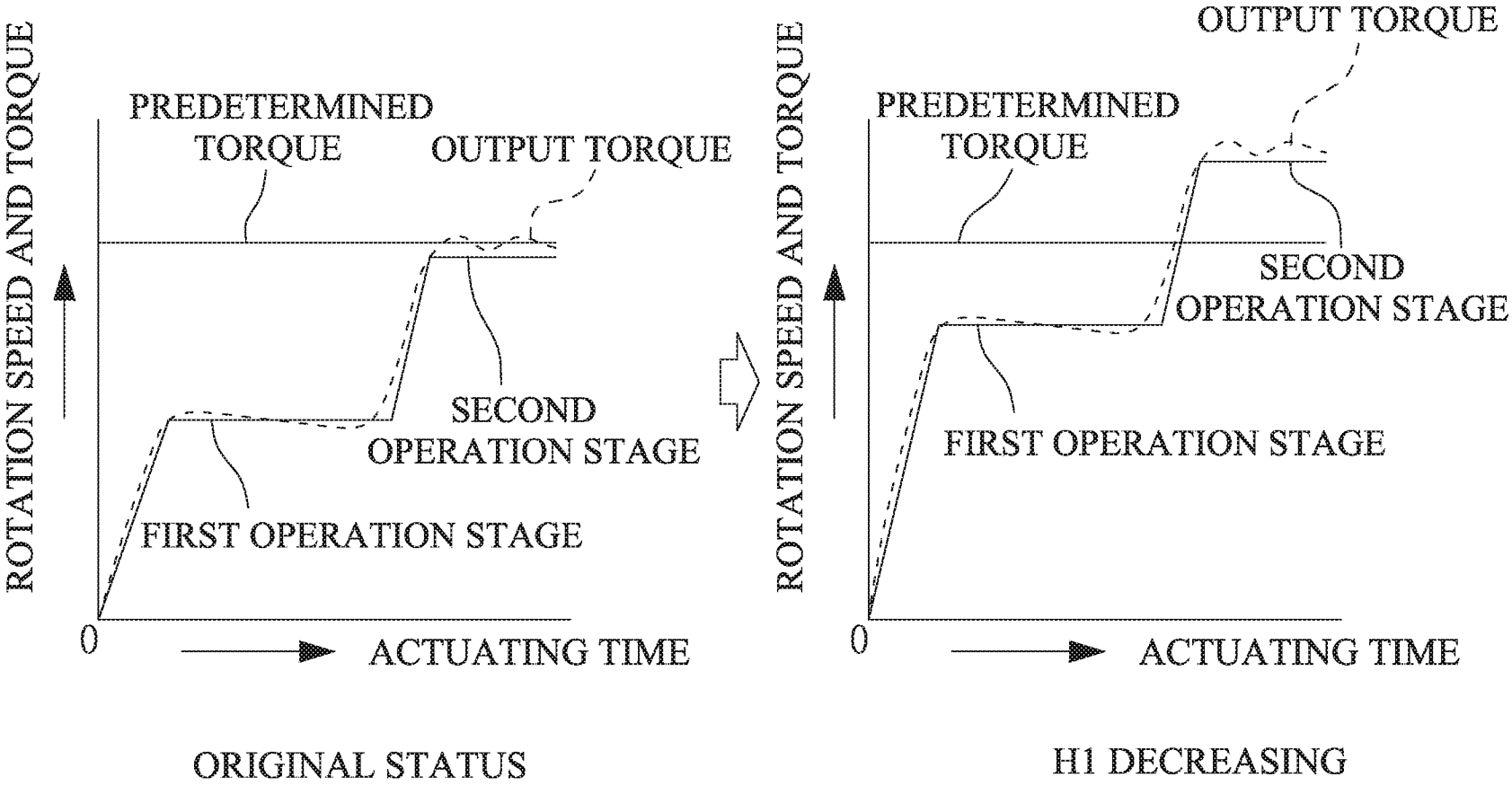
FIG. 13 shows another curved diagrams of torque, rotation speed, and actuating time of the pneumatic tool in FIG. 1 after the piston rod adjusting member is adjusted.
Figure 14:
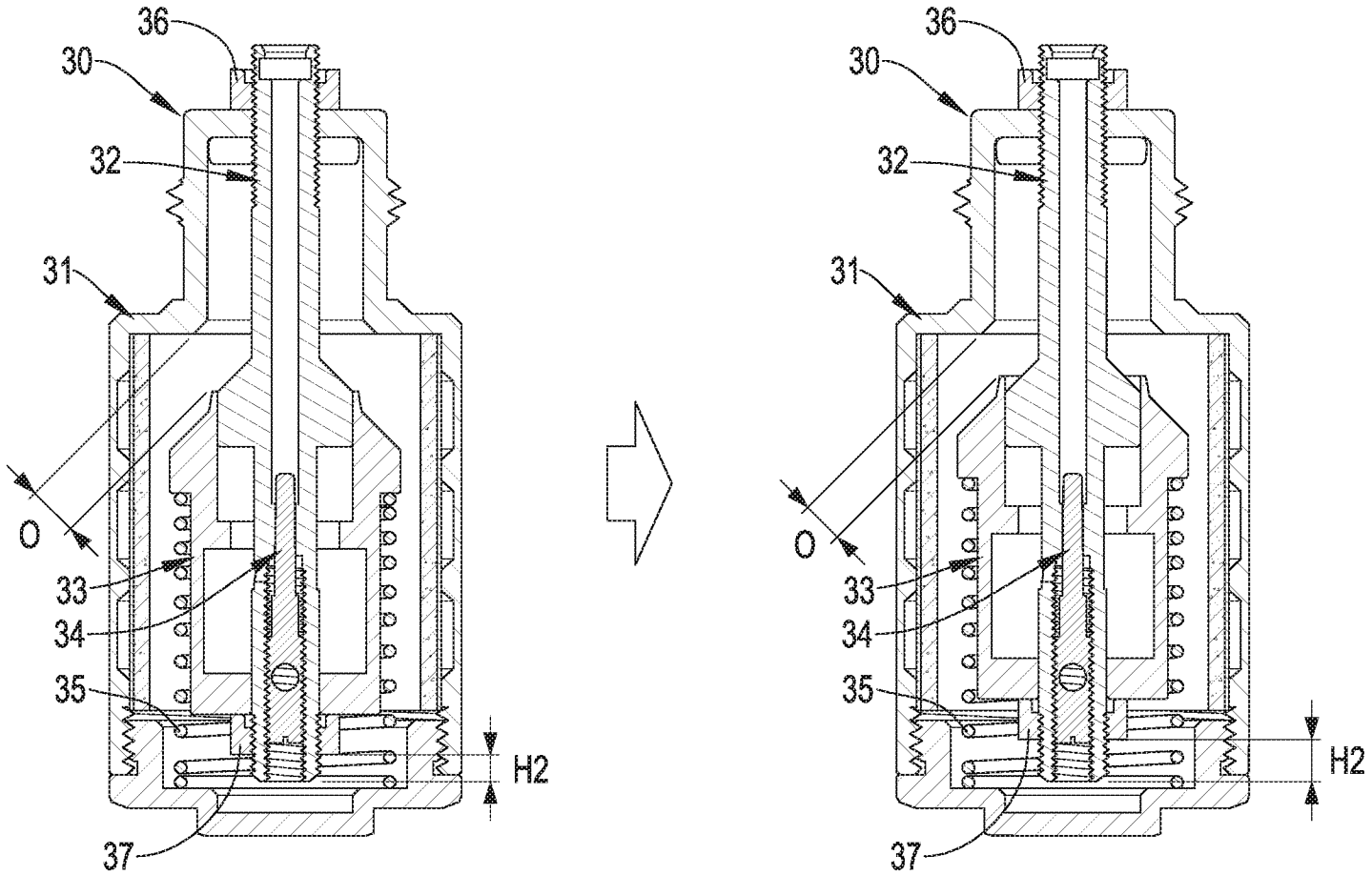
FIG. 14 shows enlarged operational cross sectional side views of the pneumatic tool in FIG. 4 showing that the piston sleeve adjusting member is adjusted in the second operational stage of the pneumatic tool.
Figure 15:
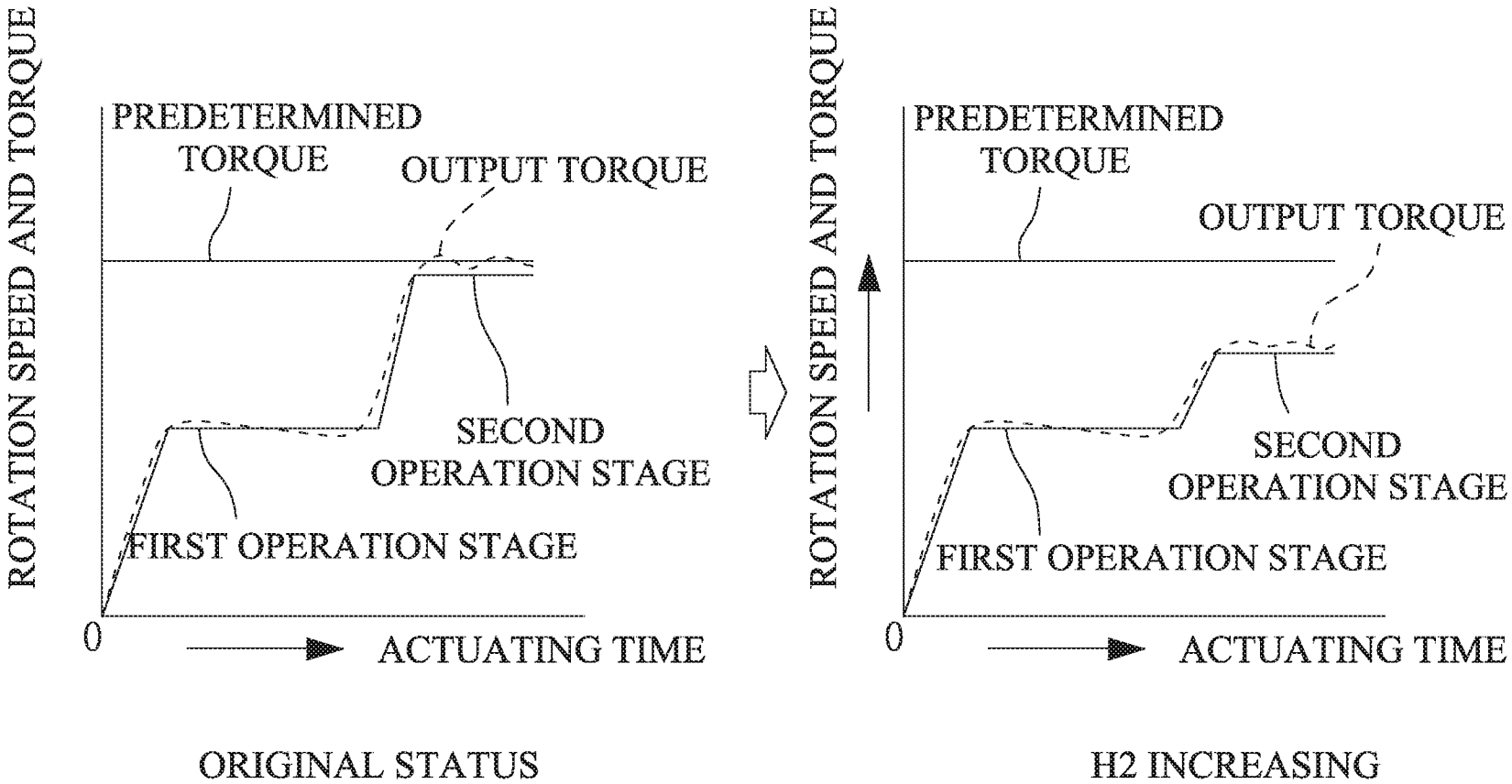
FIG. 15 shows curved diagrams of torque, rotation speed, and actuating time of the pneumatic tool in FIG. 1 after the piston sleeve adjusting member is adjusted.

On the contrary, when the piston rod adjusting element 36 is rotated and the piston rod 32 is moved downward relative to the silencer 31, the original height H will be decreased to a first height H1 as shown on the right of FIG. 10. The first height H1 may approach 0. At this time, the discharging gap O is enlarged in both the first operation stage and the second operation stage, and the amount of the discharging air is increased. With reference to FIG. 13, the rotation speed in the first operation stage is increased, and the output torque is also increased and is larger than a predetermined torque.

With reference to FIGS. 14 to 17, the rotation speeds of the pneumatic tool may be further adjusted in the second operation stage by rotating the piston sleeve adjusting member 37. When the piston sleeve adjusting member 37 is rotated and the piston sleeve 33 is moved upward relative to the piston rod 32, a second height H2 between a bottom of the piston rod 32 and a bottom of the piston rod adjusting member 36 is increased. When the second height H2 is increased, the dead end of the movement of the piston sleeve 33 will be moved upward and the movement distance of the piston sleeve 33 is reduced. Thus, the discharging gap O is reduced, and the amount of the discharging air will be reduced. Accordingly, the rotation speed of the pneumatic tool will be reduced, and the output torque will also be decreased and is smaller than a predetermined torque.

Figure 16:
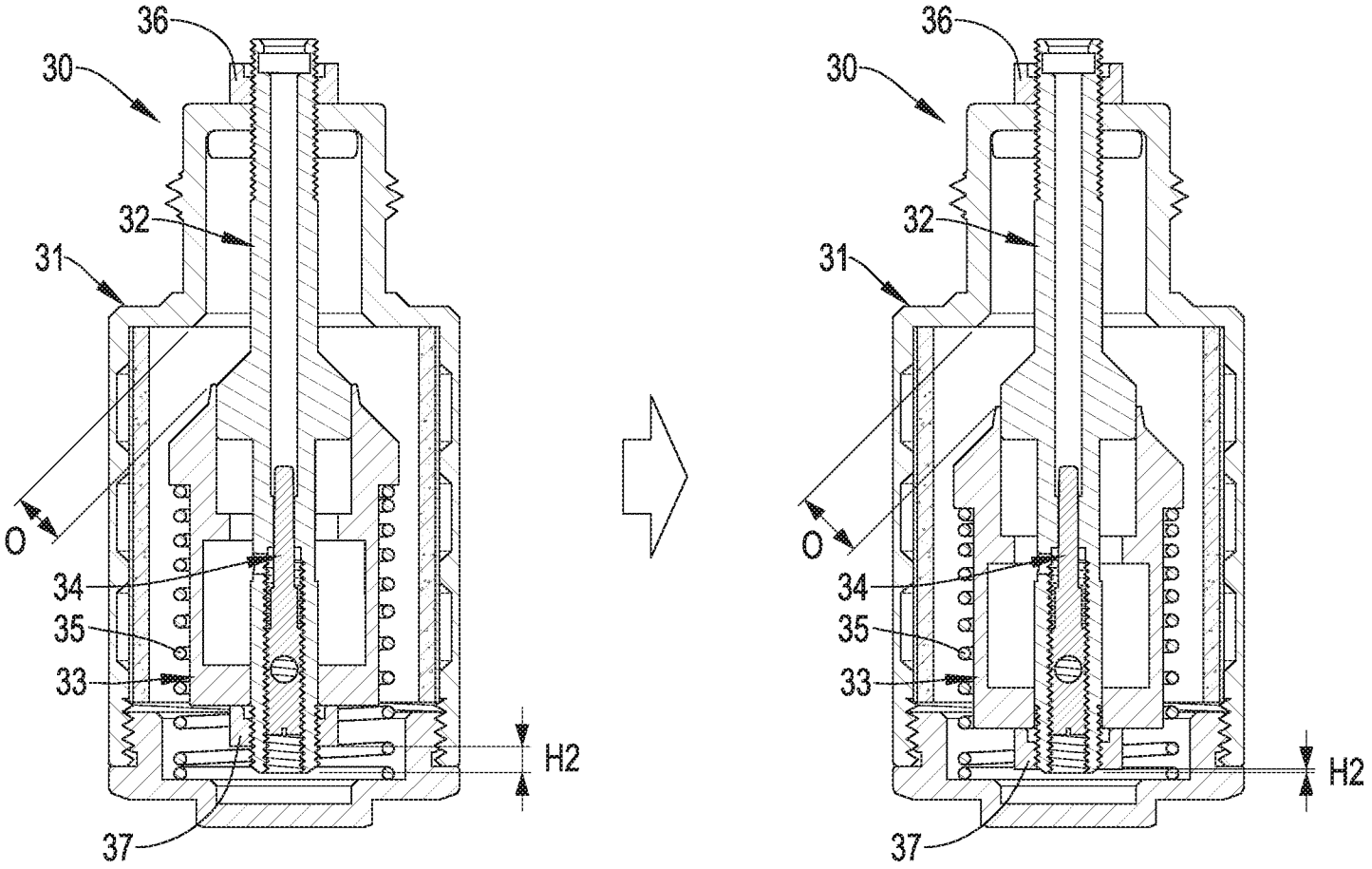
FIG. 16 shows another enlarged operational cross sectional side views of the pneumatic tool in FIG. 4 showing that the piston sleeve adjusting member is adjusted in the second operational stage of the pneumatic tool.
Figure 17:
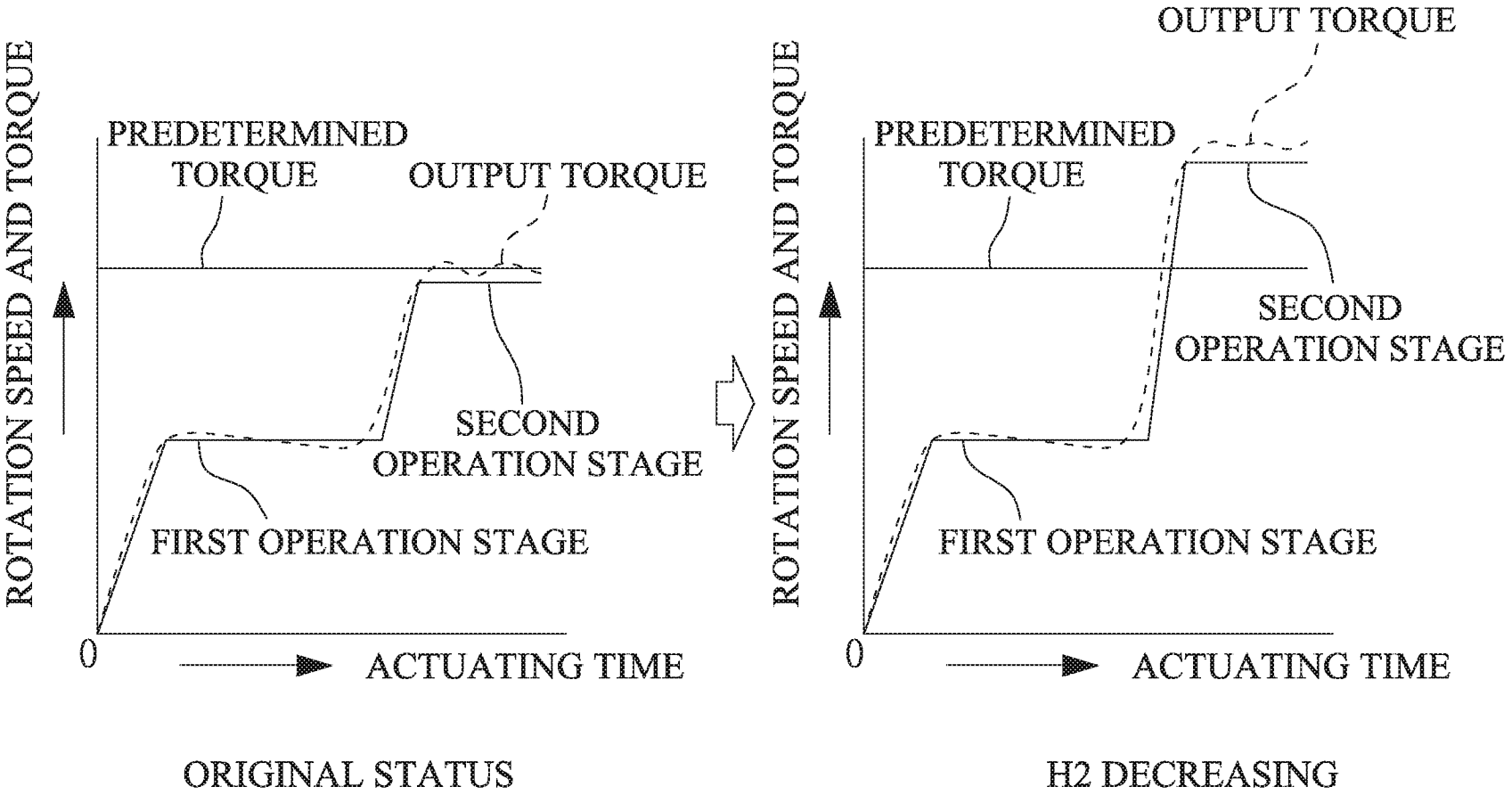
FIG. 17 shows another curved diagrams of torque, rotation speed, and actuating time of the pneumatic tool in FIG. 1 after the piston sleeve adjusting member is adjusted.

On the contrary, with reference to FIGS. 16 and 17, when the piston sleeve adjusting element 37 is rotated and the piston sleeve 33 is moved downward relative to the piston rod 32, the second height H2 will be decreased even to 0. Consequently, the discharging gap O will be enlarged, and the amount of the discharging air will be increased. Accordingly, the rotation speed and the torque of the pneumatic tool will be increased.

Figure 18:
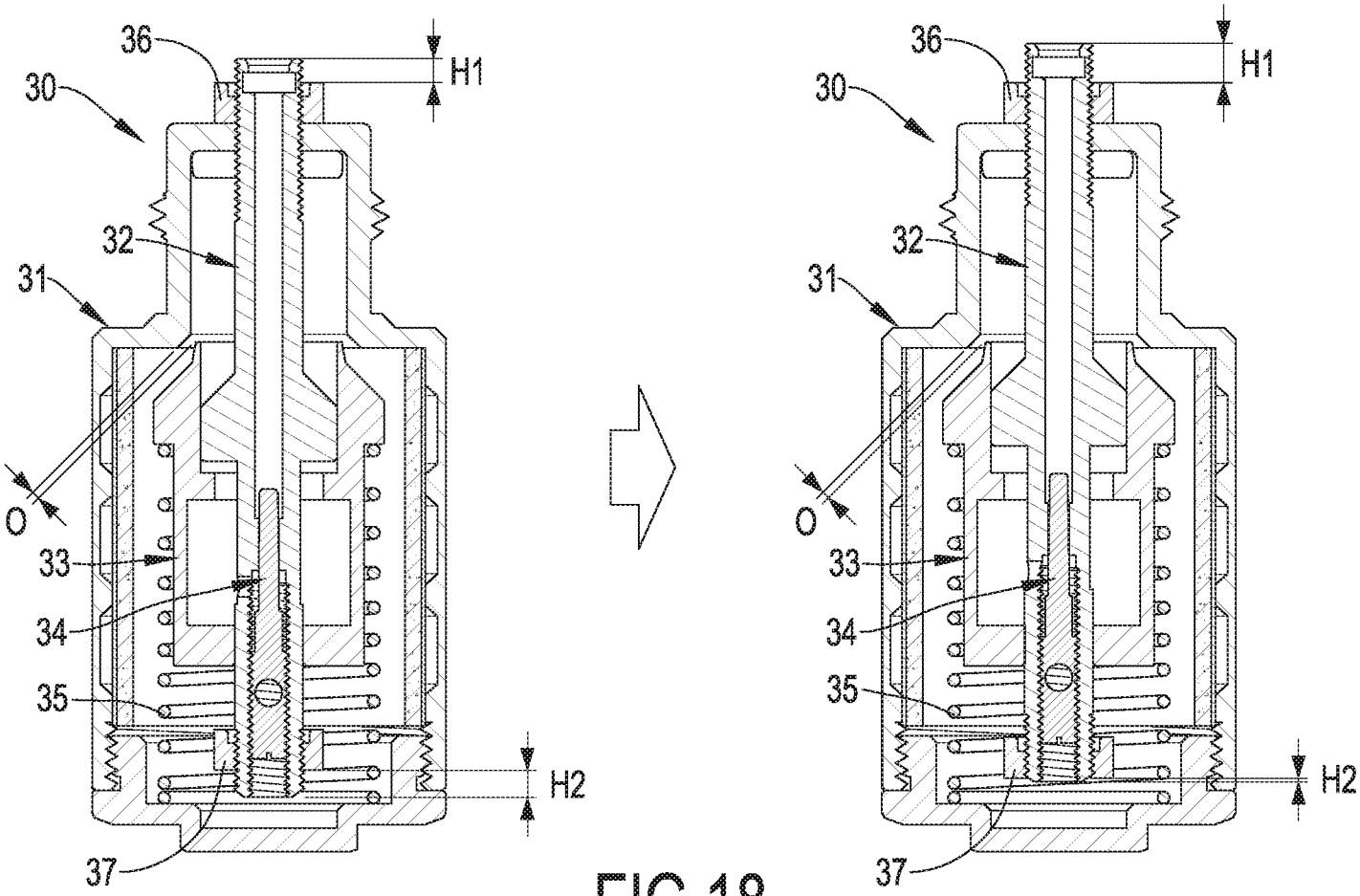
FIG. 18 shows enlarged operational cross sectional side views of the pneumatic tool in FIG. 4 showing that the piston rod adjusting member and the piston sleeve adjusting member are adjusted at the same time.
Figure 19:
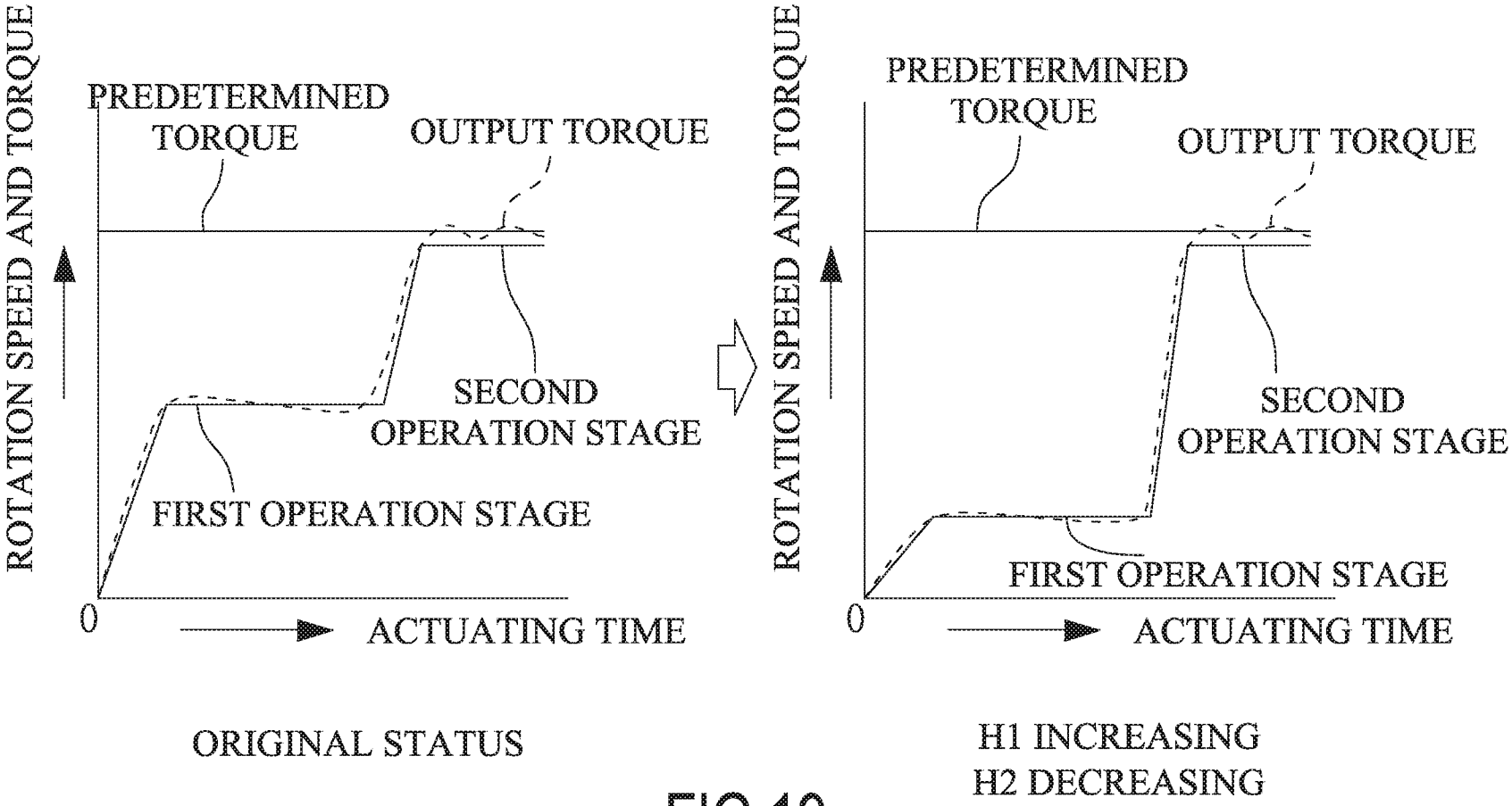
FIG. 19 shows curved diagrams of torque, rotation speed, and actuating time of the pneumatic tool in FIG. 1 after the piston sleeve adjusting member and the piston rod adjusting member are adjusted at the same time.

With reference to FIGS. 18 to 21, the piston rod adjusting member 36 and the piston sleeve adjusting member 37 can be rotated at the same time, such that the rotation speeds in the first operation stage and the second operation stage can be adjusted and the output torques are also adjusted. With reference to FIGS. 18 and 19, when the piston rod adjusting member 36 is rotated to increase the first height H1 and the piston sleeve adjusting member 37 is rotated to decrease the second height H2, the rotation speed in the first operation stage will be reduced and the rotation speed in the second operation speed is increased. Accordingly, the output torque approaches the predetermined torque.

Figure 20:
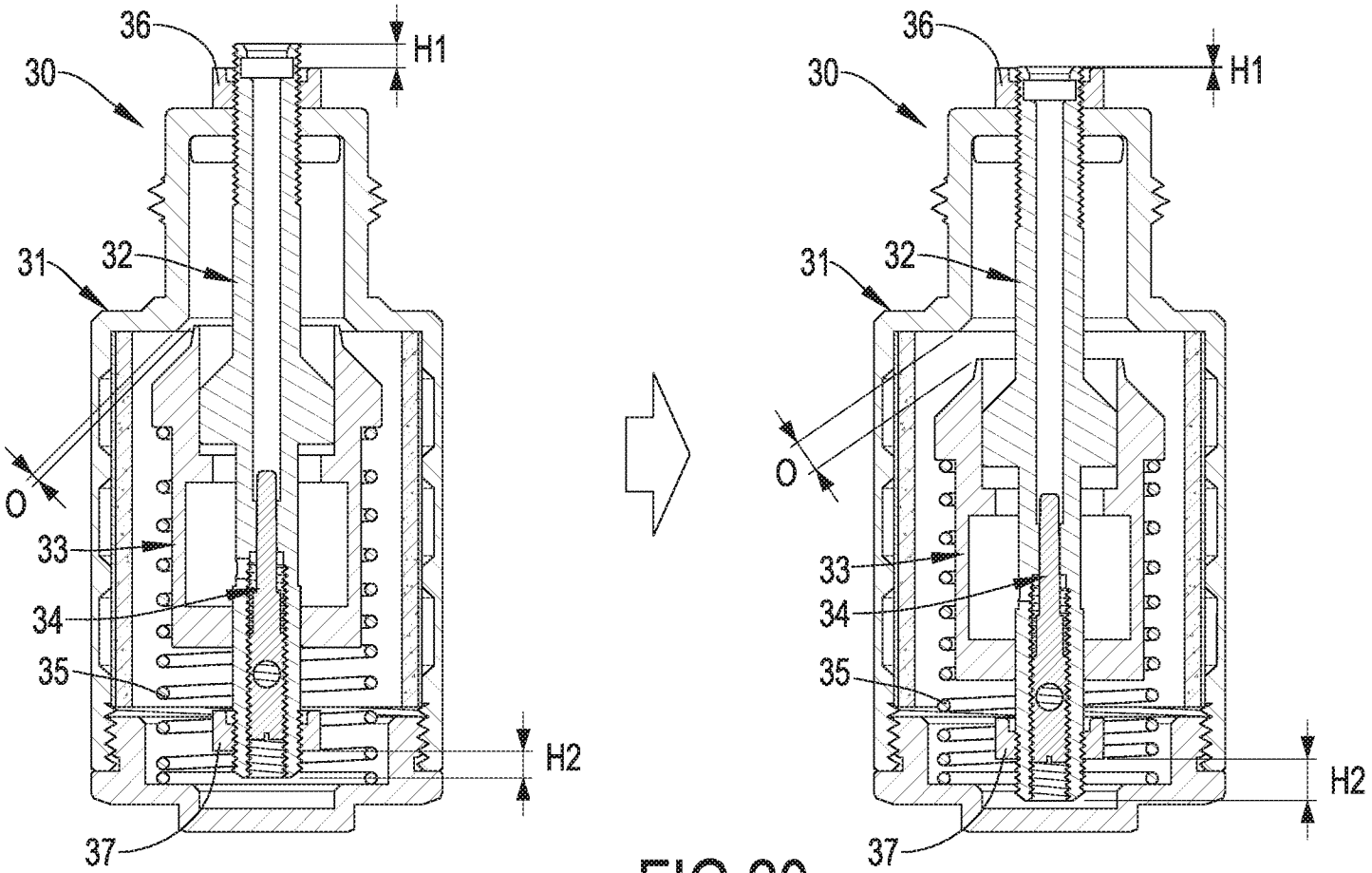
FIG. 20 shows another enlarged operational cross sectional side views of the pneumatic tool in FIG. 4 showing that the piston rod adjusting member and the piston sleeve adjusting member are adjusted at the same time.
Figure 21:
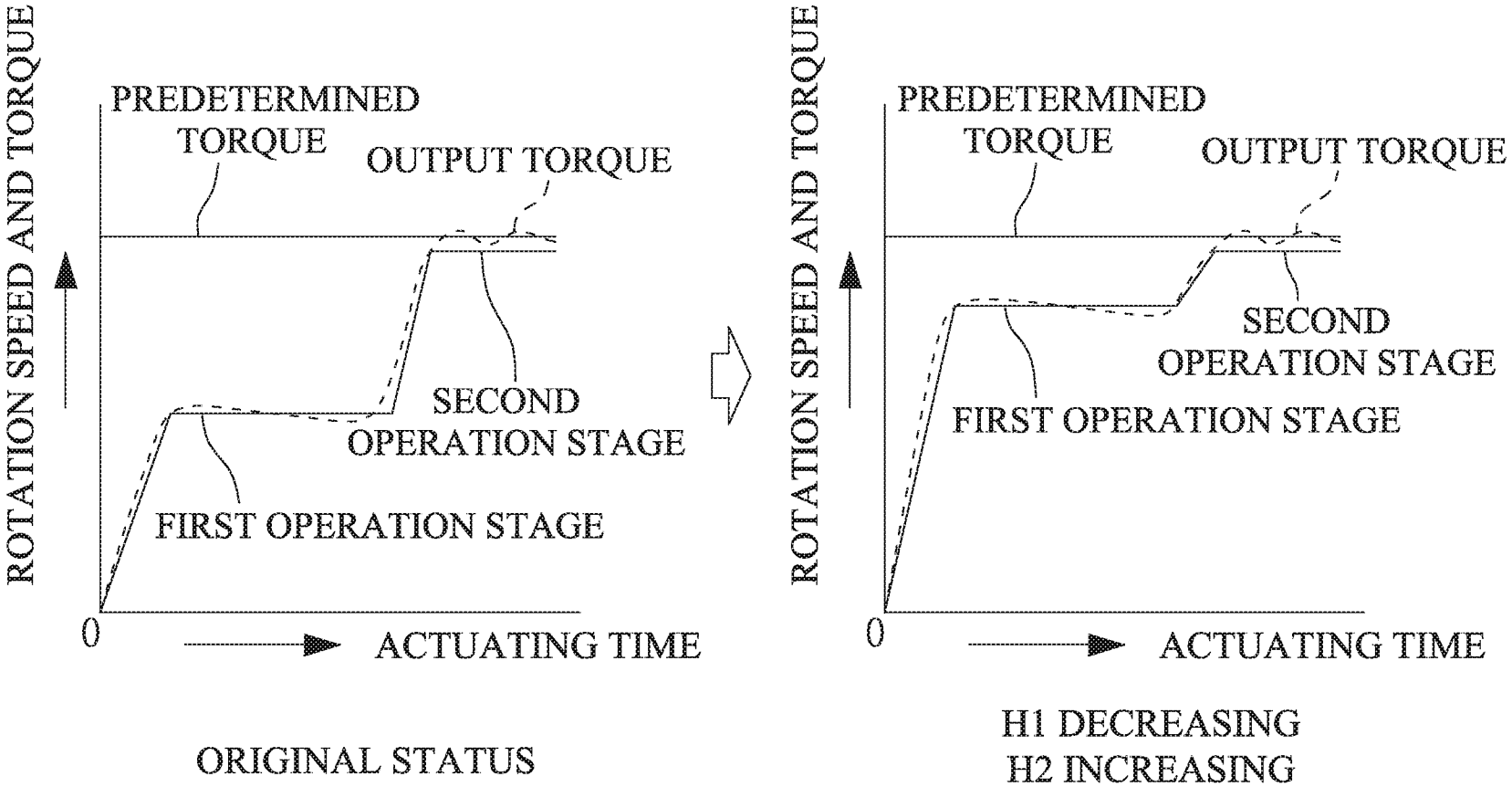
FIG. 21 shows another curved diagrams of torque, rotation speed, and actuating time of the pneumatic tool in FIG. 1 after the piston sleeve adjusting member and the piston rod adjusting member are adjusted at the same time.
Figure 22:
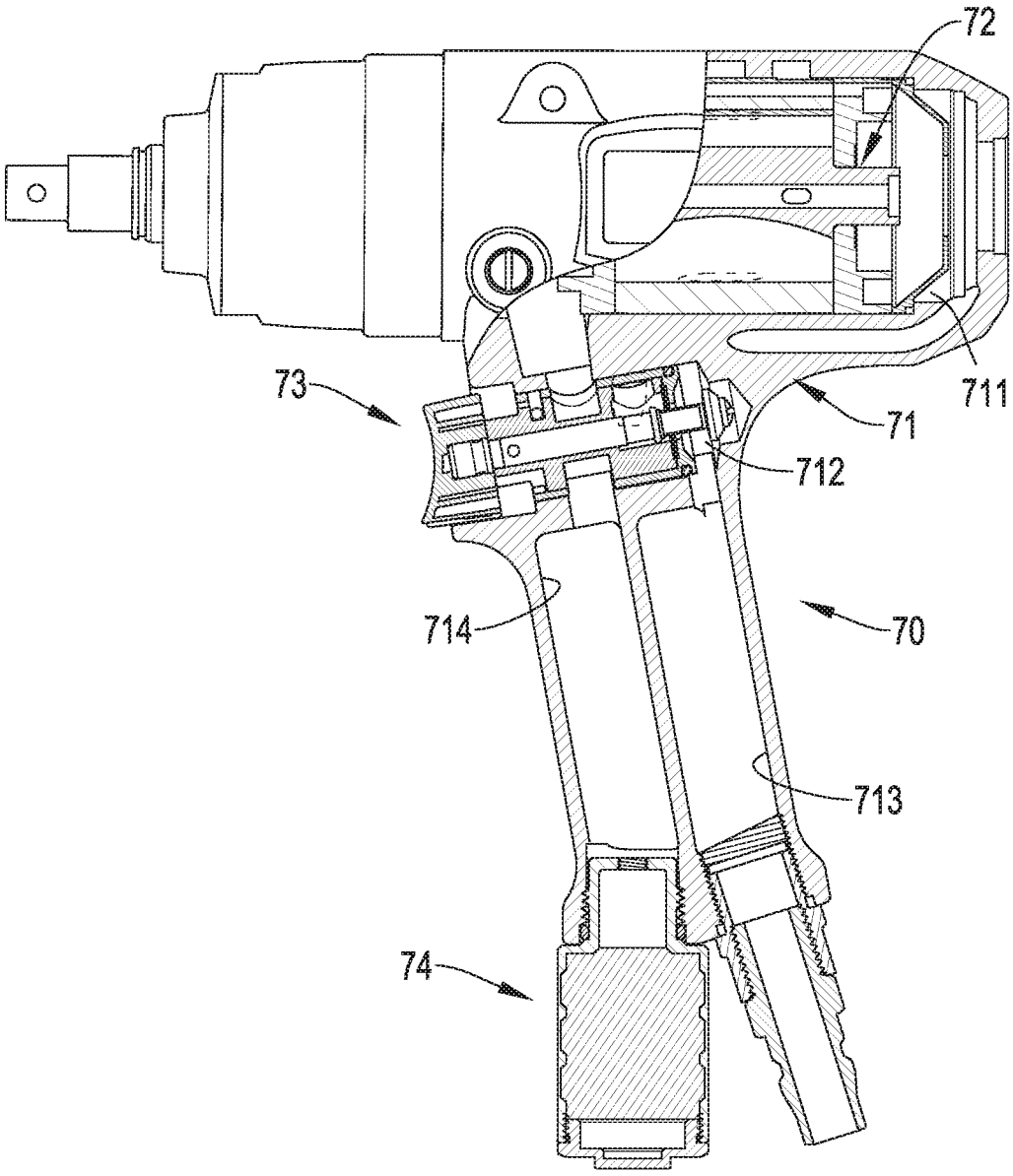
FIG.22 PRIOR ART
FIG. 22 is a side view in partial section of a conventional pneumatic tool.
Figure 23:
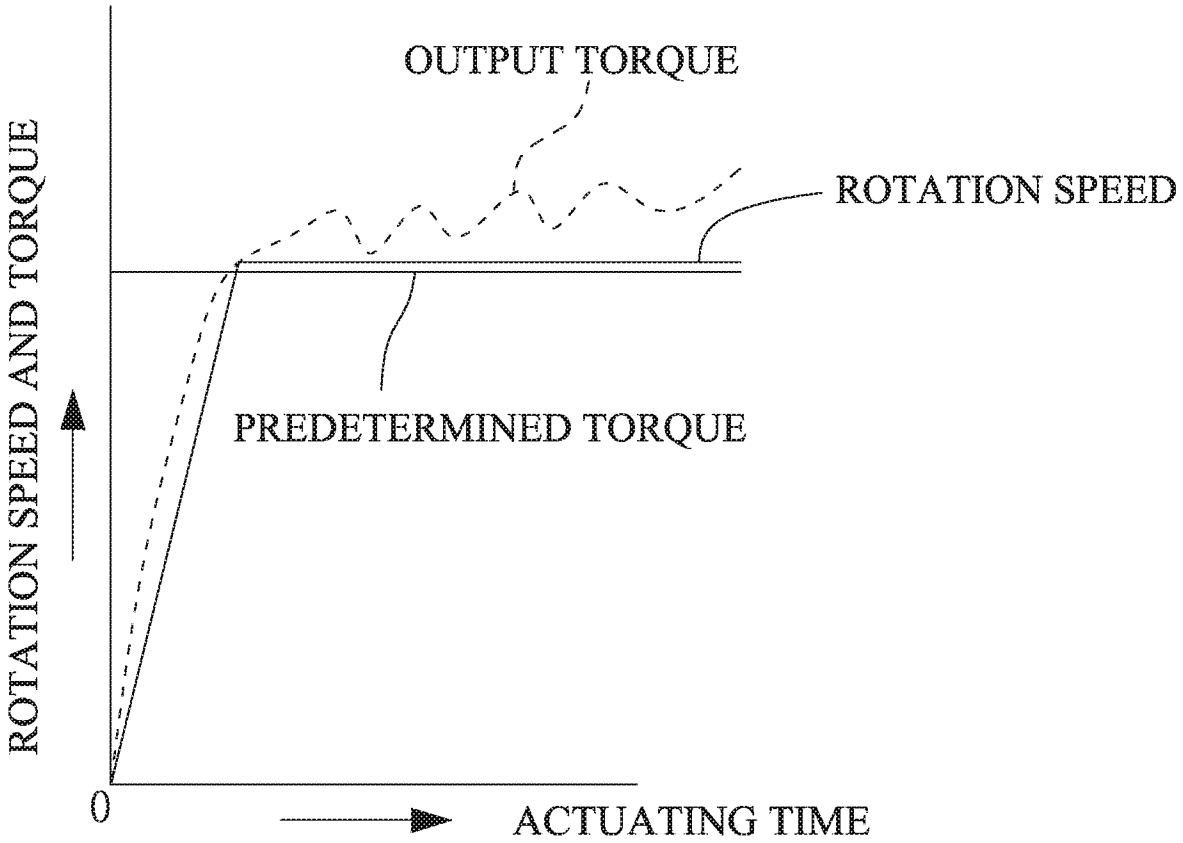
FIG.23 PRIOR ART
FIG. 23 is a curved diagram of torque, rotation speed, and actuating time of the conventional pneumatic tool in FIG. 22.

On the contrary, with reference to FIGS. 20 and 21, when the piston rod adjusting member 36 is rotated to decrease the first height H1 and the piston sleeve adjusting member 37 is rotated to increase the second height H2, the rotation speed in the first operation stage is increased and the rotation speed in the second operation stage is decreased. Accordingly, the output torque also approaches the predetermined torque.

With such an arrangement, the torque adjusting unit 30 in accordance with the present invention can be adjusted by rotating the piston rod adjusting member 36 and the piston sleeve adjusting member 37 individually or simultaneously, such that the pneumatic tool can output different torques at different operation stages, and the pneumatic tool in accordance with the present invention is versatile in use.

In addition, the pneumatic tool in accordance with the present invention has the adjusting function without using electric components or wires, and is easily achieved by modifying a conventional pneumatic tool without increasing the whole weight and volume of the conventional pneumatic tool.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pneumatic tool comprising:

a body comprising a trigger chamber defined in the body;

a trigger assembly mounted in the trigger chamber;

an inlet channel communicating with the trigger chamber; and an outlet channel communicating with the trigger chamber;

a torque adjusting unit connected with a bottom of the body, mounted on one end of the outlet channel, and comprising a silencer mounted detachably on the bottom of the body and having a discharging chamber of the silencer;

a piston rod connected adjustably with the silencer and extending into the discharging chamber;

a piston sleeve mounted around the piston rod and being axially moveable relative to the piston rod; and a spring mounted around the piston sleeve and having two ends abutting respectively the piston sleeve and the silencer; and a signal pressure transmitting unit disposed between the trigger assembly and the torque adjusting unit to transmit a signal pressure from compressed air led into the inlet channel to the piston rod of the torque adjusting unit so as to push the piston sleeve to move relative to the piston rod, and comprising a positioning member mounted on the trigger assembly; and a signal element connected with the trigger assembly and screwed with the positioning member to adjust a position of the signal element relative to the trigger assembly by rotating the positioning member;

wherein the torque adjusting unit further comprises a piston rod adjusting member mounted adjustably on an end of the piston rod to adjust a movement distance of the piston rod relative to the silencer, and a piston sleeve adjusting member mounted adjustably on an end of the piston rod opposite the piston rod adjusting member to adjust a movement distance of the piston sleeve relative to the piston rod.

2. The pneumatic tool as claimed in claim 1, wherein the piston rod has a guiding channel axially defined through the piston rod; and a discharging hole communicating with the guiding channel;

the piston sleeve has a discharging space defined in the piston sleeve and communicating with the discharging hole and the guiding channel; and the signal pressure transmitting unit communicates with the guiding channel in the piston rod.

3. The pneumatic tool as claimed in claim 2, wherein the signal pressure transmitting unit comprises a guiding tube connected between and communicating with the signal element and the piston rod.

* * * * *